US007849924B2

(12) United States Patent
Surjaatmadja et al.

(10) Patent No.: US 7,849,924 B2
(45) Date of Patent: Dec. 14, 2010

(54) METHOD AND APPARATUS FOR MOVING A HIGH PRESSURE FLUID APERTURE IN A WELL BORE SERVICING TOOL

(75) Inventors: Jim Surjaatmadja, Duncan, OK (US); Billy McDaniel, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 271 days.

(21) Appl. No.: 11/945,594

(22) Filed: Nov. 27, 2007

(65) Prior Publication Data

US 2009/0133876 A1 May 28, 2009

(51) Int. Cl.
*E21B 7/18* (2006.01)

(52) U.S. Cl. ..... 166/298; 166/177.5; 175/67

(58) Field of Classification Search ..... 166/298, 166/242.6, 213, 118, 140, 177.5; 175/424, 175/67

See application file for complete search history.

(56) References Cited

U.S. PATENT DOCUMENTS

| | | | | |
|---|---|---|---|---|
| 3,424,246 | A * | 1/1969 | Myers | 166/127 |
| 4,434,704 | A | 3/1984 | Surjaatmadja | |
| 4,671,354 | A * | 6/1987 | Henderson et al. | 166/134 |
| 4,697,638 | A * | 10/1987 | Knight | 166/65.1 |
| 4,799,554 | A * | 1/1989 | Clapp et al. | 166/312 |
| 5,325,923 | A | 7/1994 | Surjaatmadja et al. | |
| 5,335,724 | A * | 8/1994 | Venditto et al. | 166/298 |
| 5,361,856 | A | 11/1994 | Surjaatmadja et al. | |
| 5,381,862 | A * | 1/1995 | Szarka et al. | 166/212 |
| 5,396,957 | A | 3/1995 | Surjaatmadja et al. | |
| 5,484,016 | A | 1/1996 | Surjaatmadja et al. | |
| 5,494,103 | A | 2/1996 | Surjaatmadja et al. | |
| 5,499,678 | A | 3/1996 | Surjaatmadja et al. | |

(Continued)

FOREIGN PATENT DOCUMENTS

EP 0 851 094 7/1998

(Continued)

OTHER PUBLICATIONS

Foreign communication related to a counterpart application dated Nov. 21, 2008.

*Primary Examiner*—David J Bagnell
*Assistant Examiner*—Kipp C Wallace
(74) *Attorney, Agent, or Firm*—John W. Wustenberg; Conley Rose P.C.

(57) ABSTRACT

A well bore servicing apparatus comprising a housing having a longitudinal axis and a through bore, and a movable member disposed in said housing, said movable member having a through bore and a fluid aperture therein, wherein said movable member is movable between a first stop position and a second stop position relative to said housing and along said axis, wherein said fluid aperture is in fluid communication with said housing through bore and said movable member through bore to provide a fluid stream to the well bore in said first and second axially spaced stop positions. A well bore servicing apparatus comprising a work string, a housing coupled to said work string, and a member slidably coupled to said housing, said slidable member having a fluid jetting nozzle and a fluid path therethrough communicating fluid to said fluid jetting nozzle, wherein said slidable member is operable to place said fluid jetting nozzle in a plurality of axially spaced stop positions relative to said housing and said work string.

22 Claims, 8 Drawing Sheets

U.S. PATENT DOCUMENTS

| | | | | |
|---|---|---|---|---|
| 5,533,571 | A | 7/1996 | Surjaatmadja et al. | |
| 5,765,642 | A | 6/1998 | Surjaatmadja | |
| 5,944,105 | A | 8/1999 | Nguyen | |
| 6,041,855 | A * | 3/2000 | Nistor | 166/50 |
| 6,286,599 | B1 | 9/2001 | Surjaatmadja et al. | |
| 6,336,502 | B1 | 1/2002 | Surjaatmadja et al. | |
| 6,662,874 | B2 | 12/2003 | Surjaatmadja et al. | |
| 6,719,054 | B2 | 4/2004 | Cheng et al. | |
| 6,725,933 | B2 | 4/2004 | Middaugh et al. | |
| 6,779,607 | B2 | 8/2004 | Middaugh et al. | |
| 6,889,771 | B1 * | 5/2005 | Leising et al. | 166/373 |
| 6,938,690 | B2 | 9/2005 | Surjaatmadja | |
| 7,090,153 | B2 | 8/2006 | King et al. | |
| 7,195,067 | B2 | 3/2007 | Manke et al. | |
| 7,213,655 | B2 * | 5/2007 | Parrott | 166/380 |
| 7,225,869 | B2 | 6/2007 | Willett et al. | |
| 7,234,529 | B2 | 6/2007 | Surjaatmadja | |
| 2005/0133226 | A1 | 6/2005 | Lehman | |
| 2006/0042801 | A1 * | 3/2006 | Hackworth et al. | 166/387 |
| 2006/0086507 | A1 | 4/2006 | Surjaatmadja et al. | |
| 2006/0185848 | A1 | 8/2006 | Surjaatmadja et al. | |
| 2007/0175637 | A1 | 8/2007 | Leising et al. | |
| 2008/0047716 | A1 * | 2/2008 | McKee et al. | 166/384 |

FOREIGN PATENT DOCUMENTS

| | | |
|---|---|---|
| WO | 9747850 | 12/1997 |
| WO | WO 2005/090747 | 9/2005 |
| WO | WO 2007/129084 | 11/2007 |

* cited by examiner

METHOD AND APPARATUS FOR MOVING A HIGH PRESSURE FLUID APERTURE IN A WELL BORE SERVICING TOOL

BACKGROUND

Hydrocarbon-producing wells often are stimulated by hydraulic fracturing operations, wherein a fracturing fluid may be introduced into a portion of a subterranean formation penetrated by a well bore at a hydraulic pressure sufficient to create or enhance at least one fracture therein. Stimulating or treating the well in such ways increases hydrocarbon production from the well.

In some wells, it may be desirable to individually and selectively create multiple fractures along a well bore at a distance apart from each other. The multiple fractures should have adequate conductivity, so that the greatest possible quantity of hydrocarbons in an oil and gas reservoir can be drained/produced into the well bore. When stimulating a reservoir from a well bore, especially those well bores that are highly deviated or horizontal, it may be difficult to control the creation of multi-zone fractures along the well bore without cementing a casing or liner to the well bore and mechanically isolating the subterranean formation being fractured from previously-fractured formations, or formations that have not yet been fractured.

To avoid explosive perforating steps and other undesirable actions associated with fracturing, certain tools may be placed in the well bore to place fracturing fluids under high pressure and direct the fluids into the formation. In some tools, high pressure fluids may be "jetted" into the formation. For example, a tool having jet forming apertures or nozzles, also called a "hydrojetting" or "hydrajetting" tool, may be placed in the well bore near the formation. The jet forming nozzles create a high pressure fluid flow path directed at the formation of interest. In another tool, which may be called a tubing window, a stimulation sleeve, or a stimulation valve, a section of tubing includes holes or apertures pre-formed in the tubing. The tubing window may also include an actuatable window assembly for selectively exposing the tubing holes to a high pressure fluid inside the tubing. The tubing holes may include jet forming nozzles to provide a fluid jet into the formation, causing tunnels and fractures therein.

The fluid jetting apertures or nozzles in the fluid jetting tools are in fixed positions in the tool body. For example, a hydrojetting tool may have one or more high pressure fluid paths therethrough with nozzles affixed at the outlet of each fluid path. The nozzles are located at various fixed locations about the tool body. In another example, a stimulation sleeve may include multiple fluid jetting apertures also in fixed positions about the sleeve body. Often times a good fluid treatment or fracturing operation will require creating numerous holes in the formation, above and/or below the original position of the fluid jetting tool. Further, aligning the additional formation holes created by the tool prevents tortuous formation fracture paths that twist between randomly located holes. To create numerous fracturing holes along a well bore, a fluid jetting tool may need to be moved from its original deployed and activated position to a position above or below the original position, where additional holes can be made. A fluid jetting tool deployed on a work string, such as coiled tubing, is moved by pulling up on the work string. However, pulling up on the work string by a few inches or more does not translate to similar movement by the fluid jetting tool. Friction between the work string and the well bore prevents uphole movement of the work string from translating smoothly to movement of the fluid jetting tool, if at all.

Moreover, it is desirable for the fracturing holes to be aligned or angled in a precise manner. The awkward and clumsy tugging and rotating of the work string cannot ensure such precision.

To achieve desirable results in the aforementioned fluid treatment processes, increased control over the fluid jetting process is needed. Such needed control is pushing the limits of current fluid treatment systems. The present disclosure includes embodiments for increased fluid jetting control, for example, by downhole-initiated movement of the fluid jets.

SUMMARY

Disclosed herein is a well bore servicing apparatus comprising a housing having a longitudinal axis and a through bore, and a movable member disposed in said housing, said movable member having a through bore and a fluid aperture therein, wherein said movable member may be movable between a first stop position and a second stop position relative to said housing and along said axis, wherein said fluid aperture may be in fluid communication with said housing through bore and said movable member through bore to provide a fluid stream to the well bore in said first and second axially spaced stop positions. The second stop position may be diagonally spaced from said first position relative to said axis. The first and second stop positions may include different positions of said high pressure fluid aperture relative to the well bore. The movable member may be a tubular member slidable within said housing. The slidable tubular member may include a jet head having a plurality of fluid apertures. The fluid aperture may include a jetting nozzle. The fluid aperture may be movable to a plurality of axially spaced stop positions. The apparatus may further include a J-slot and lug disposed within said J-slot guiding relative movement between said movable member and said housing. The J-slot may be coupled to said housing and said lug may be coupled to said movable member. The J-slot may be coupled to said movable member and said lug may be coupled to said housing. The J-slot may be rotatably disposed between said housing and said movable member. The apparatus may further comprise an axially slotted member and a second lug disposed in said axially slotted member to prevent rotation of said movable member relative to said axis. The apparatus may further comprise a set screw to selectively prevent rotation of said J-slot. The apparatus may further comprise a locking mechanism disposed between said J-slot and said axially slotted member. The locking mechanism may further comprise a slip ring, a lock ring and a retention member. The retention member may be coupled to said movable member, said slip ring may be coupled to said J-slot and disposed between said J-slot and said retention member, and said lock ring may be coupled between said retention member and said axially slotted member. The slip ring may be moved to be coupled to said retention member and disposed between said retention member and said axially slotted member, and said lock ring may be moved to be coupled between said J-slot and said retention member. The stop positions may comprise a plurality of precise positions relative to said housing and said fluid stream may be communicated by said fluid aperture only in said stop positions. The apparatus may further comprise a work string coupled to said housing, said movable member operable to place said fluid aperture in a plurality of precise positions relative to said work string. The fluid aperture may operate at a pressure of from about 3,500 p.s.i. to about 15,000 p.s.i.

Also disclosed herein is a well bore servicing apparatus comprising a work string, a housing coupled to said work string and a member slidably coupled to said housing, said slidable member having a fluid jetting nozzle and a fluid path therethrough communicating fluid to said fluid jetting nozzle, wherein said slidable member may be operable to place said fluid jetting nozzle in a plurality of axially spaced stop positions relative to said housing and said work string. The slidable member may communicate with said housing via a slot and lug arrangement. The slot and lug arrangement may include a continuous J-slot. The slot may include a plurality of notches for receiving said lug, said plurality of notches corresponding to said plurality of fluid jetting nozzle stop positions. The work string may be fixed in the well bore while said fluid jetting nozzle may be moved between said plurality of different stop positions. The high pressure fluid path may be controlled to communicate fluid to said fluid jetting nozzle only in said plurality of different stop positions. The stop positions may be axially aligned relative to a well bore axis. The stop positions may be diagonally aligned relative to a well bore axis.

Further disclosed herein is a method of servicing a well bore comprising disposing a tool string having a fluid aperture in the well bore, positioning the fluid aperture at a first location in the well bore, fixing the work string in the well bore, pumping a well bore servicing fluid through the tool string to the fluid aperture at the first location, moving the fluid aperture relative to the fixed work string to an axially spaced location in the well bore, and pumping the well bore servicing fluid at the axially spaced location. The method may further comprise stopping pumping of the well bore servicing fluid at the first location to move the fluid aperture from the first location to the axially spaced location. The method of moving the fluid aperture may further comprise moving the fluid aperture to a plurality of precise locations relative to the well bore. The method of moving the fluid aperture may further comprise moving the fluid aperture to a plurality of locations along a longitudinal axis of the well bore. The method of moving the high pressure fluid aperture may further comprise moving a lug through a continuous J-slot. The method may further comprise fracturing a formation at the first location. The method may further comprise perforating a casing at the first location before fracturing the formation. The method may further comprise fracturing a formation at the second location. The method may further comprise perforating a casing at the second location before fracturing the formation. The method may further comprise pressurizing the tool to hold the fluid aperture at the first location, de-pressurizing the tool before moving the fluid aperture, and re-pressurizing the tool to hold the fluid aperture at the axially spaced location.

Further disclosed herein is a method of servicing a well bore comprising disposing a tool having a fluid aperture in the well bore, providing a fluid to the tool and the fluid aperture, applying a fluid stream from the fluid aperture to the well bore to create a jetted hole in the well bore, and axially aligning a plurality of jetted holes in the well bore.

Further disclosed herein is a method of servicing a well bore comprising placing a jetting tool in the well bore via a workstring, actuating a jetting tool through one or more longitudinal positions, and forming a corresponding one or more longitudinal jetted holes in the well bore. The workstring may be held in a substantially fixed longitudinal position during actuation of the jetting tool. The jetting tool may be actuated through a plurality of longitudinal J-slots. The jetting tool may be actuated via a pressure differential. The well bore may be deviated.

BRIEF DESCRIPTION OF THE DRAWINGS

For a more detailed description of the embodiments, reference will now be made to the following accompanying drawings.

DETAILED DESCRIPTION

Figure 1:
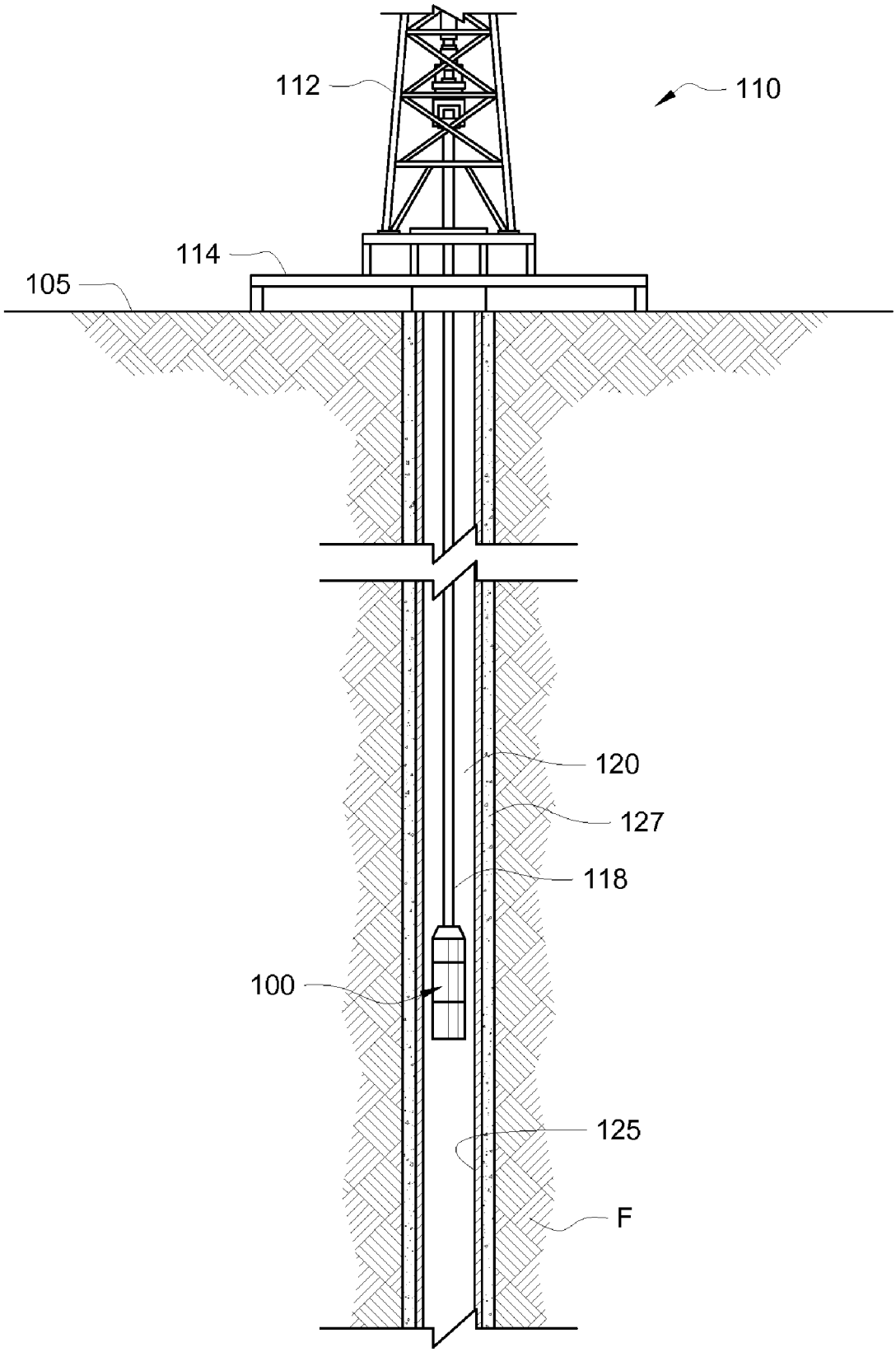
FIG. 1 is a schematic, partial cross-section view of a fluid jetting tool in an operating environment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. The various characteristics mentioned above, as well as other features and characteristics described in more detail below, will be readily apparent to those skilled in the art upon reading the following detailed description of the embodiments, and by referring to the accompanying drawings.

Disclosed herein are several embodiments of well bore servicing apparatus including a fluid jetting tool, wherein pressurized fluid is directed or jetted through fluid apertures into an earth formation to create and extend fractures in the earth formation. The apparatus may be disposed at a location in the well. It may be desired to create a series of jetted holes in the formation at or near this location, particularly in the longitudinal direction along the axis of the well. Creating a series of axially spaced apart holes in the formation can be problematic because manual movement of the fluid jetting tool is imprecise, or impossible due to friction forces in deviated or horizontal wells. Therefore, the fluid jetting tool is operable to place one or more high pressure fluid apertures at a plurality of axially spaced positions. In some embodiments, the apertures move relative to a work string suspending the jetting tool in the well. The work string may be fixed in the well. In some embodiments, the apertures are placed in a jet head of a slidable member received in a housing that is coupled to the work string. In other embodiments, the apertures move both axially and rotationally about an axis. The apertures may include fluid jetting nozzles. In some embodiments, the moveable apertures are directed by a J-slot or indexing slot. Certain embodiments include components having variable arrangements to adjust the axial and rotational movements of the apertures. Such components include set screws, plugs, and lock and slip ring mechanisms.

Referring to FIG. 1, a schematic representation of an exemplary operating environment for a fluid jetting tool 100 is shown. As disclosed below, there are various embodiments of the fluid jetting tool 100, and the schematic tool 100 is consistent with those fluid jetting tools described herein and others consistent with the teachings herein. As depicted, a drilling rig 110 is positioned on the earth's surface 105 and extends over and around a well bore 120 that penetrates a subterranean formation F for the purpose of recovering hydrocarbons. The well bore 120 may drilled into the subterranean formation F using conventional (or future) drilling techniques and may extend substantially vertically away from the surface 105 or may deviate at any angle from the surface 105. In some instances, all or portions of the well bore 120 may be vertical, deviated, horizontal, and/or curved.

At least the upper portion of the well bore 120 may be lined with casing 125 that may be cemented 127 into position against the formation F in a conventional manner. Alternatively, the operating environment for the fluid stimulation tool 100 includes an uncased well bore 120. The drilling rig 110 includes a derrick 112 with a rig floor 114 through which a work string 118, such as a cable, wireline, E-line, Z-line, jointed pipe, coiled tubing, or casing or liner string (should the well bore 120 be uncased), for example, extends downwardly from the drilling rig 110 into the well bore 120. The work string 118 suspends a representative downhole fluid jetting tool 100 to a predetermined depth within the well bore 120 to perform a specific operation, such as perforating the casing 125, expanding a fluid path therethrough, or fracturing the formation F. The work string 18 may also be known as the entire conveyance above and coupled to the fluid jetting tool 100. The drilling rig 110 is conventional and therefore includes a motor driven winch and other associated equipment for extending the work string 118 into the well bore 120 to position the fluid jetting tool 100 at the desired depth.

While the exemplary operating environment depicted in FIG. 1 refers to a stationary drilling rig 110 for lowering and setting the fluid stimulation tool 100 within a land-based well bore 120, one of ordinary skill in the art will readily appreciate that mobile workover rigs, well servicing units, such as coiled tubing units, and the like, could also be used to lower the tool 100 into the well bore 120. It should be understood that the fluid jetting tool 100 may also be used in other operational environments, such as within an offshore well bore or a deviated or horizontal well bore.

Figure 2:
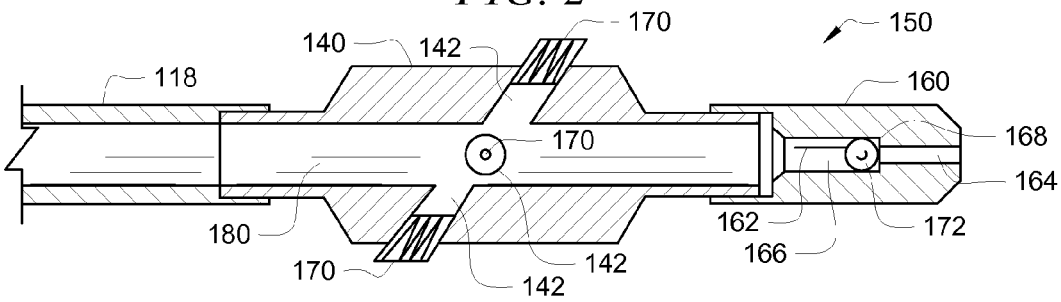
FIG. 2 is a cross-section view of a hydrojetting tool assembly.

The fluid jetting tool 100 may take a variety of different forms. In an embodiment, the tool 100 comprises a hydrojetting tool assembly 150, which in certain embodiments may comprise a tubular hydrojetting tool 140 and a tubular, ball-activated, flow control device 160, as shown in FIG. 2. The tubular hydrojetting tool 140 generally includes an axial fluid flow passageway 180 extending therethrough and communicating with at least one angularly spaced lateral port 142 disposed through the sides of the tubular hydrojetting tool 140. In certain embodiments, the axial fluid flow passageway 180 communicates with as many angularly spaced lateral ports 142 as may be feasible (e.g., a plurality of ports). A fluid jet forming nozzle 170 generally is connected within each of the lateral ports 142. As used herein, the term "fluid jet forming nozzle" refers to any fixture that may be coupled to an aperture so as to allow the communication of a fluid therethrough such that the fluid velocity exiting the fixture is higher than the fluid velocity at the entrance of the fixture. In certain embodiments, the fluid jet forming nozzles 170 may be disposed in a single plane that may be positioned at a predetermined orientation with respect to the longitudinal axis of the tubular hydrojetting tool 140. Such orientation of the plane of the fluid jet forming nozzles 170 may coincide with the orientation of the plane of maximum principal stress in the formation to be fractured relative to the longitudinal axis of the well bore penetrating the formation.

The tubular, ball-activated, flow control device 160 generally includes a longitudinal flow passageway 162 extending therethrough, and may be threadedly connected to the end of the tubular hydrojetting tool 140 opposite from the work string 118. The longitudinal flow passageway 162 may comprise a relatively small diameter longitudinal bore 164 through an exterior end portion of the tubular, ball-activated, flow control device 160 and a larger diameter counter bore 166 through the forward portion of the tubular, ball-activated, flow control device 160, which may form an annular seating surface 168 in the tubular, ball-activated, flow control device 160 for receiving a ball 172. Before ball 172 is seated on the annular seating surface 168 in the tubular, ball-activated, flow control device 160, fluid may freely flow through the tubular hydrojetting tool 140 and the tubular, ball-activated, flow control device 160. After ball 172 is seated on the annular seating surface 168 in the tubular, ball-activated, flow control device 160 as illustrated in FIG. 2, flow through the tubular, ball-activated, flow control device 160 may be terminated, which may cause fluid pumped into the work string 118 and into the tubular hydrojetting tool 140 to exit the tubular hydrojetting tool 140 by way of the fluid jet forming nozzles 170 thereof. When an operator desires to reverse-circulate fluids through the tubular, ball-activated, flow control device 160, the tubular hydrojetting tool 140 and the work string 118, the fluid pressure exerted within the work string 118 may be reduced, whereby higher pressure fluid surrounding the tubular hydrojetting tool 140 and tubular, ball-activated, flow control device 160 may flow freely through the tubular, ball-activated, flow control device 160, causing the ball 172 to disengage from annular seating surface 168, and through the fluid jet forming nozzles 170 into and through the work string 118.

The hydrojetting tool assembly 150, schematically represented at 100 in FIG. 1, may be moved to different locations in the well bore 120 by using work string 118. Pulling and turning the work string 118, as previously described, may achieve some, mostly uncontrolled movement of the tool assembly 150. Work string 118 also carries the fluid to be jetted through jet forming nozzles 170.

Figure 3A:
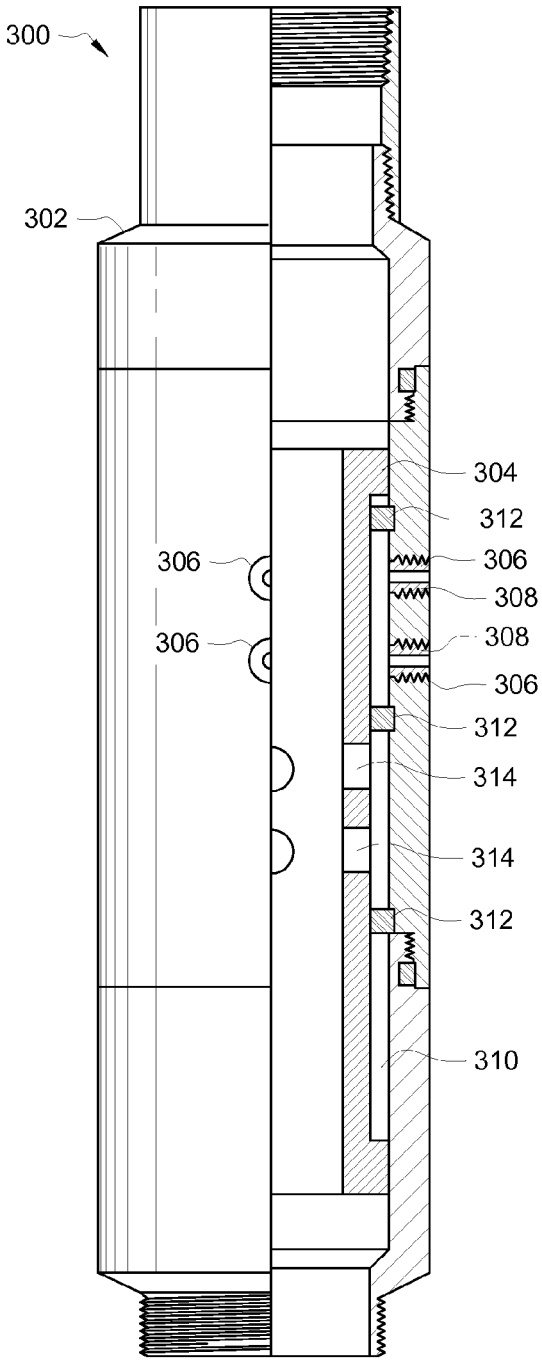
FIG. 3A is a partial cross-section view of a hydrojetting tubing window assembly.
Figure 3B:
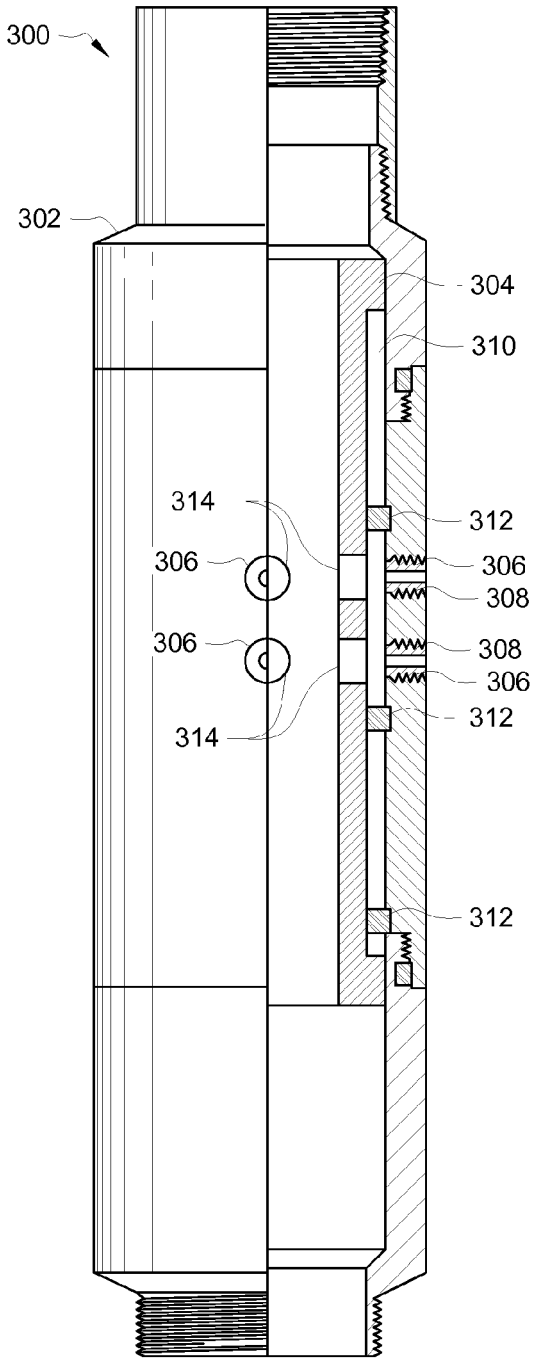
FIG. 3B is a partial cross-section view of the tubing window assembly of FIG. 3A in a shifted position.

Referring now to FIGS. 3A and 3B, an exemplary tubing window assembly 300 is shown as adapted for use in a well completion assembly. As used herein, the term "tubing window" refers to a section of tubing configured to enable selective access to one or more specified zones of an adjacent subterranean formation. A tubing window has a structural member that may be selectively opened and closed by an operator, for example, movable sleeve member 304. The tubing window assembly 300 can have numerous configurations and can employ a variety of mechanisms to selectively access one or more specified zones of an adjacent subterranean formation.

The tubing window 300 includes a substantially cylindrical outer tubing 302 that receives a movable sleeve member 304. The outer tubing 302 includes one or more apertures 306 to allow the communication of a fluid from the interior of the outer tubing 302 into an adjacent subterranean formation. The apertures 306 are configured such that fluid jet forming nozzles 308 may be coupled thereto. In some embodiments, the fluid jet forming nozzles 308 may be threadably inserted into the apertures 306. The fluid jet forming nozzles 308 may be isolated from the annulus 310 (formed between the outer tubing 302 and the movable sleeve member 304) by coupling seals or pressure barriers 312 to the outer tubing 302.

The movable sleeve member 304 includes one or more apertures 314 configured such that, as shown in FIG. 3A, the apertures 314 may be selectively misaligned with the apertures 306 so as to prevent the communication of a fluid from the interior of the movable sleeve member 304 into an adjacent subterranean formation. The movable sleeve member 304 may be shifted axially, rotatably, or by a combination thereof such that, as shown in FIG. 3B, the apertures 314 selectively align with the apertures 306 so as to allow the communication of a fluid from the interior of the movable sleeve member 304 into an adjacent subterranean formation. The movable sleeve member 304 may be shifted, for example, via the use of a shifting tool, a hydraulic activated mechanism, or a ball drop mechanism.

Figure 4A:
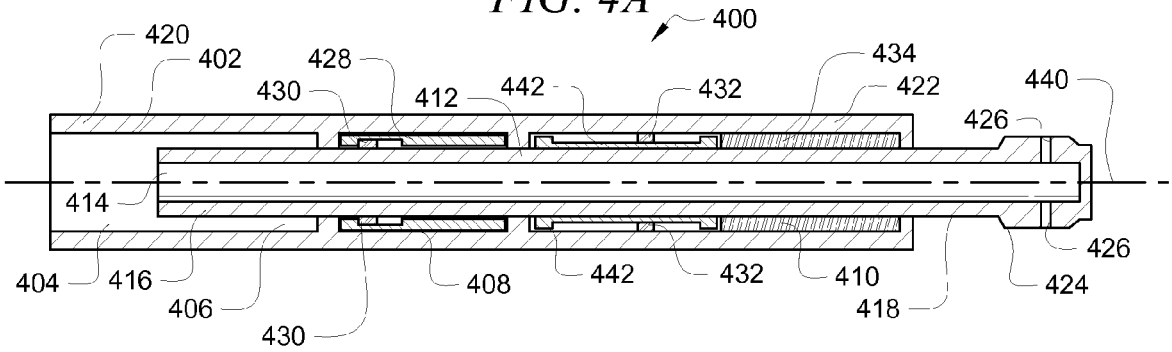
FIG. 4A is a cross-section view of an embodiment of a fluid jetting tool with moveable jetting apertures.

Referring now to FIG. 4A, an embodiment of a fluid jetting apparatus or tool 400 is shown schematically and in cross-section. Fluid jetting tool 400 includes a body or housing 402 having a flow bore 404 therethrough. The interior of the housing 402 may be separated into a cavity or chamber 406, a chamber 408, a chamber 410, and additional chambers if needed. A movable member 412 is disposed in the housing 402. In some embodiments, as shown in FIG. 4A, the movable member 412 is a tubular member having a flow bore 414 therethrough and being slidably supported by the housing 402. An upper end 416 of the tube 412 is disposed in the cavity 406 at an upper end 420 of the housing 402. The upper end 420 may be coupled to a work string or another tool ultimately coupled to a work string. A lower end 418 of the tube 412 extends through a lower end 422 of the housing 402 and projects away from the housing 402. The chamber 410 at the lower end 422 includes a spring 434. The lower end 418 further includes a head 424 having a high pressure fluid aperture 426 (or a plurality of apertures 426, as shown). In some embodiments, the apertures further include fluid jet forming nozzles consistent with the teachings herein.

The jetting tool 400 also includes a J-slot 428. The J-slot may also be called a continuous J-slot, a control groove or indexing slot. As shown in the embodiment of FIG. 4A, the J-slot 428 is disposed about the tube 412 in the chamber 408. The J-slot 428, in some embodiments, may be a solid member, such as a metal sheet, having a slot or groove formed therein. The J-slot may be shaped to extend around a cylindrical member, as is shown in FIG. 4A. In various embodiments of the tool 400, the J-slot 428 includes different relationships with surrounding components. For example, in some embodiments, the J-slot 428 is not fixed to any other component, such as the housing 402 or the tube 412, and is rotary about the tube 412 in the chamber 408. For example, the J-slot 428 may be embodied in a loose sleeve disposed within the chamber 408. The outer surface of the tube 412 includes a lug or control pin 430 (or set of lugs 430) extending outwardly from the tube 412 outer surface and received in the J-slot 428. In such embodiments, all or substantially all rotational movement is executed by the J-slot 428 while the tube 412 (and thus the jet head 424 and apertures 426) remains rotationally fixed about the axis 440. In these embodiments, the housing 402 is also fixed about the axis 440 via its connection to the work string.

In other embodiments of the tool 400, the J-slot 428 is coupled to the inner surface of the chamber 408 and the lugs 430 extend from the tube 412 and into the J-slot. In still further embodiments, the members are reversed, wherein the J-slot 428 is coupled to the surface of the tube 412 and the lug 430 extends from the chamber 408 inner surface and into the J-slot. In these fixed-slot embodiments, the J-slot 428 is in a fixed position relative to the chamber 408 and the housing 402, and the tube 412, respectively. In these embodiments, relative motion between the J-slot 428 and the lug 430 extending from the tube 412 causes any rotational motion about the longitudinal axis 440 to be done by the tube 412 (and relative to the fixed housing 402).

Thus, in some embodiments of the jetting apparatus 400 disclosed herein, the movable member (e.g., tube 412) having the high pressure fluid aperture is moved longitudinally or axially to displace the aperture in a linear manner parallel to the longitudinal axis of the tool. In alternative embodiments, the movable member (e.g., tube 412) is allowed rotational movement in addition to axial movement. The combined axial and rotational movement of the fluid aperture causes the aperture to be displaced diagonally relative to the longitudinal axis of the tool. The embodiments just discussed are more fully shown and described hereinafter.

Figure 4B:
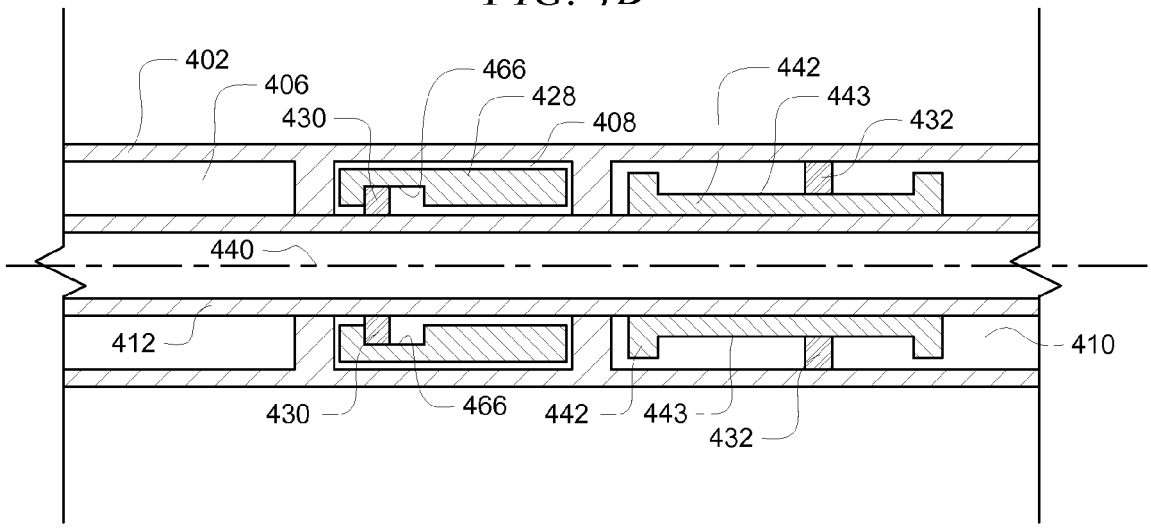
FIG. 4B is an enlarged view of a portion of the fluid jetting tool of FIG. 4A.

Still referring to FIG. 4A, the embodiment shown includes a tube 412 that is fixed rotationally about the longitudinal axis 440. The inner surface of chamber 410 includes a lug or set of lugs 432 extending into a slotted member 442 coupled to the tube 412. Referring now to FIG. 4B, an enlarged, cross-section view of the middle portion of the jetting tool 400 is shown. The slotted member 442, coupled to the tube 412, includes a longitudinal or axial slot 443 that receives the lug 432. The slot 443 and lug 432 arrangement allows the tube 412 to move longitudinally along the axis 440, but fixes the tube 412 rotationally. In other embodiments, the locations of the slotted member 442 and the lug 432 are switched, wherein the slotted member 442 is coupled to the inner wall of the chamber 410 and the lug 432 is coupled to the tube 412. To enable axial movement of the tube 412, but not rotational movement, the J-slot 428 is allowed to rotate. As shown in FIG. 4B, the J-slot 428 is loose and not coupled to any adjacent components, and thereby is allowed to rotate freely about the tube 412 and the axis 440 (though otherwise retained by the chamber 408). The lug, or lugs, 430 extend into a notch 466 in the J-slot 428. As the tube 412 is encouraged to move in a longitudinal direction, the lug 430 is guided through the J-slot into different notches or positions, as will be described more fully hereinafter. As the lug 430, and therefore the tube 412, advances longitudinally, the J-slot 428 rotates while the slot 443 and lug 432 prevents substantially all rotational movement of the tube 412.

Figure 5:
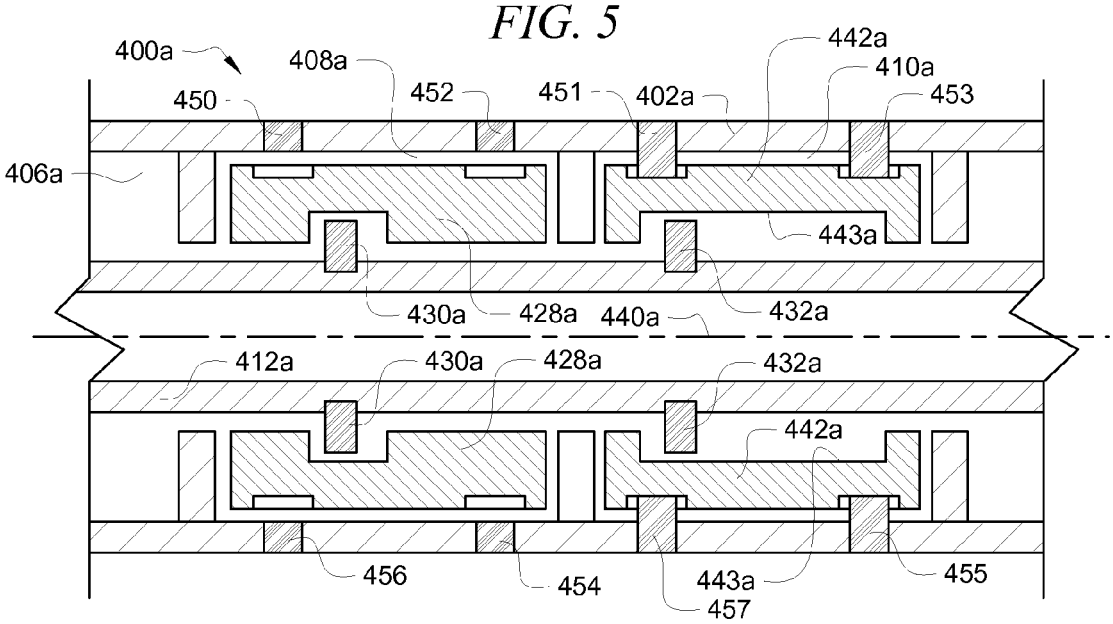
FIG. 5 is an alternative embodiment of the portion of the fluid jetting tool of FIG. 4B.

Referring now to FIG. 5, other embodiments also include rotation-free, axial movement of the tube 412. A tool 400*a* includes a tube 412*a* having lugs 430*a* and 432*a*. The lugs 430*a* project into a J-slot 428*a* in a chamber 408*a*. The lugs 432*a* project into slots 443*a* of a slotted member 442*a*. In other embodiments, the tool 400*a* includes one each of the lugs 430*a*, 432*a* and the slots 428*a*, 442*a*. The housing at the chamber 408*a* includes one or more plugs or actuatable set screws 450, 452, 454, 456 disposed adjacent the J-slot 428*a*. The J-slot 428*a* also includes plug receptacles 481, 483, 485, 487. The housing at the chamber 410*a* includes one or more actuatable set screws 451, 453, 455, 457 disposed adjacent the slotted member 442*a*. The slotted member 442*a* includes receptacles 491, 493, 495, 497. In the embodiment shown, plugs 450, 452, 454, 456 are disengaged from, or not in contact with, the J-slot 428*a*. The set screws 451, 453, 455, 457 are engaged or in contact with the slotted member 442*a* at the mating receptacles 491, 493, 495, 497. Thus, the J-slot 428*a* is allowed to rotate while the fixed slotted member 442*a* only allows the lugs 432*a* to move axially along the longitudinal slots 443*a*. Consequently, the tube 412*a* is allowed to move axially, but not rotationally, similar to the movement of the tube 412 of FIGS. 4A and 4B.

Other embodiments of the tool 400*a* add rotational movement of the tube 412*a*. The plugs 450, 452, 454, 456 may be actuated to engage the J-slot 428*a* at the receptacles 481, 483, 485, 487, thereby making the J-slot 428*a* fixed or stationary. Also, the set screws 451, 453, 455, 457 may be actuated to disengage the slotted members 442*a*. Thus, as the lugs 430*a* move through the different J-slot positions (as described more fully hereinafter), the tube 412*a* is allowed to move axially as well as rotationally because the disengaged slots 442*a* simply rotate with the lugs 432*a* disposed therein. Plugs and set screws may be used interchangeably in the embodiment described, and their operation are understood by one having skill in the art. For example, the tool 400*a* is removed to a surface of the well and the plugs or set screws are actuated, as described, by an operator and/or tool as is understood by one having skill in the art.

Figure 6A:
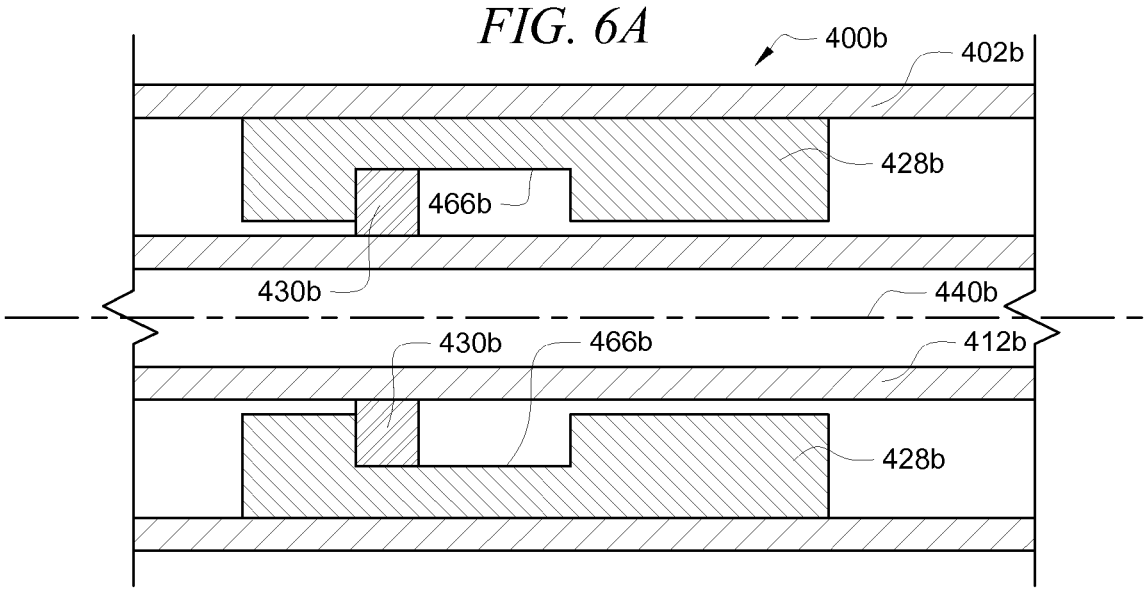
FIG. 6A is an alternative embodiment of the portion of the fluid jetting tool of FIG. 4B.

In other embodiments, alternative arrangements allow the movable member (e.g., tube 412) to move both axially and rotationally. Referring now to FIG. 6A, a tool 400*b* includes a tube 412*b* disposed inside a housing 402*b*. The tube 412*b* includes one or more lugs 430*b*. The housing 402*b* includes a J-slot 428*b* coupled thereto. The fixed J-slot 428*b* is a cylinder coupled to the inner surface of the housing 402*b*, or, in other embodiments, the J-slot is simply a slot machined into the inner surface of the housing 402*b*. A notch or notches 466*b* receive the lugs 430*b*. As the lugs 430*b* move through the notches or positions in the fixed J-slot 428*b*, the tube 412*b* is free to move both axially and rotationally.

Figure 6B:
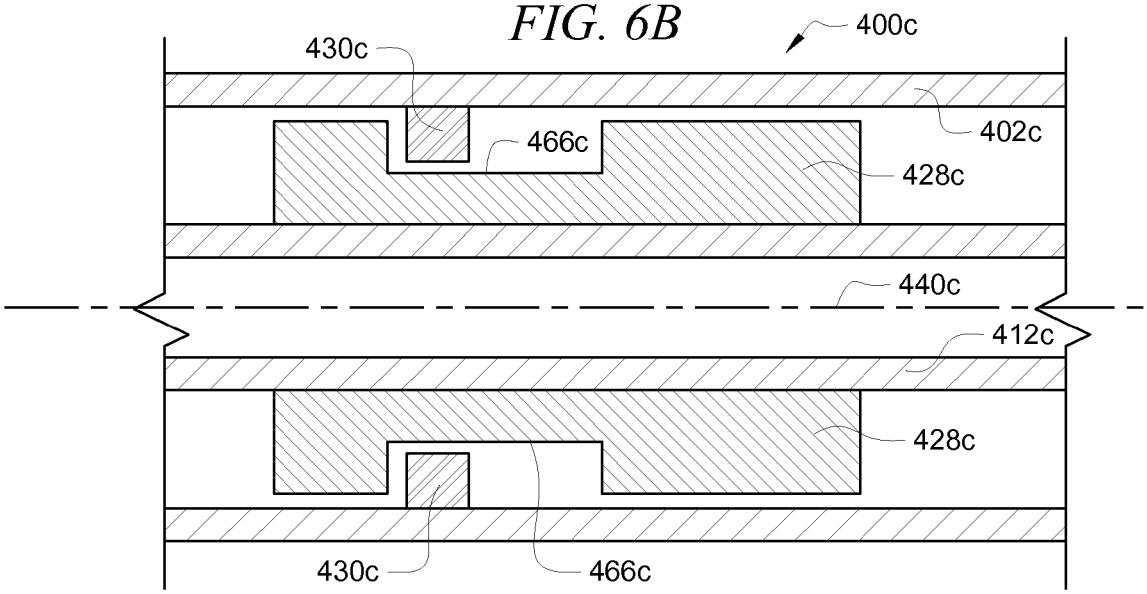
FIG. 6B is an alternative embodiment of the portion of the fluid jetting tool of FIG. 6A.

In some embodiments, the locations of the fixed J-slot and the mating lug are switched. Referring now to FIG. 6B, a tool 400*c* includes lugs 430*c* coupled to the housing 402*c* while a J-slot 428*c* is coupled to or machined into a tube 412*c*. As the lugs 430*c* move through the J-slot 428*c*, the fixed nature of the lugs 430*c* and the J-slot 428*c* causes the tube 412*c* to move axially and rotationally.

Figure 7A:
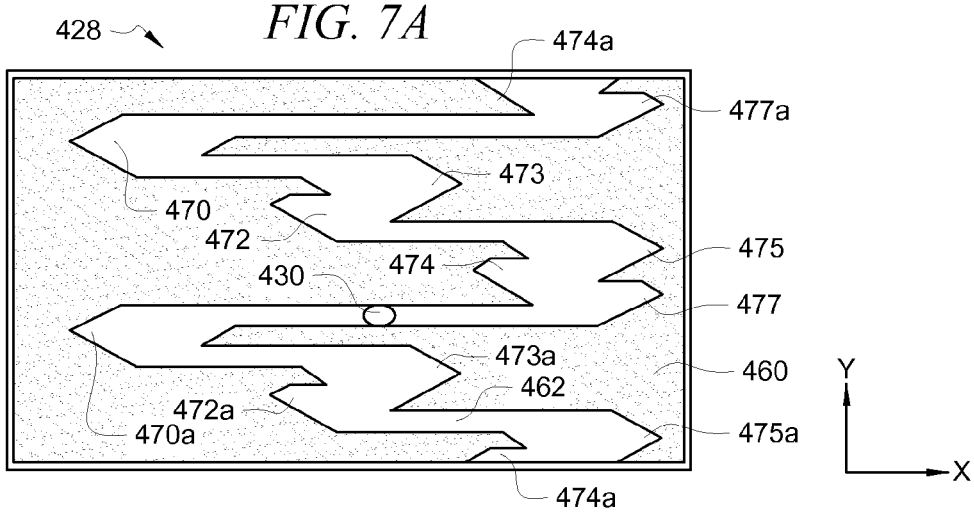
FIG. 7A is a profile view of an exemplary J-slot or indexing slot.

Referring now to FIG. 7A, an embodiment of the J-slot 428 is shown having the unwrapped profile 460. For example, FIG. 7A represents a J-slot pattern in an unwrapped or "flattened" cylindrical sleeve. The profile 460 includes a guide slot or control groove 462 having a first set of notches or positions 470, 472, 474 and a second set of notches or positions 470*a*, 472*a*, 474*a*. A lug, such as the lug 430, will be guided through the guide slot 462 in response to forces applied to the lug (via the tube 412 in the exemplary embodiment of FIG. 4). The lug may start at a first relaxed position 477*a* wherein an actuating force is not being applied to the lug and a biasing force maintains the lug in the position 477*a*. With reference to the exemplary embodiment of FIG. 4, the biasing spring 434 provides the biasing force causing the tube 412 to be in a retracted position wherein the jet head 424 is positioned in close proximity to the lower end 422 of the housing 402 (the relative positions of the tube 412 and head 424 to the housing 402 are not necessarily to scale). A high pressure fluid may be provided to the tool 400, such as via the work string 118. The high pressure fluid flows through flow bores 404, 414 to actuate the tube 412. As used herein, high pressure, for example, is generally greater than about 1,000 p.s.i., alternatively greater than about 3,500 p.s.i., alternatively greater than about 10,000 p.s.i., and alternatively greater than about 15,000 p.s.i. The high pressure fluid provides a force to overcome the biasing force, thereby axially moving the tube 412 while the lug is guided from the relaxed stationary position 477*a* through the slot 462 to a first fixed or stop position 470. The position 470 may also be called a first locked position because, as the high pressure fluid continues to flow into the tool 400, the lug is continuously forced into the notch and the tube is maintained in this position. The high pressure fluid flow allows a high pressure fluid stream or streams to be provided through the apertures 426 to the well bore for a desired length of time.

When desired, such as upon sufficient jetted holes being formed at a precise location in the well bore, the high pressure fluid in the tool 400 can be decreased. This causes the biasing spring 434 to relax and force the tube 412 to move axially upward until the lug reaches a second relaxed position 473. When it is desired to create another jetted hole in the well bore at a different precise location, the fluid pressure is increased, the biasing force is again overcome, and the lug is guided by the angled slot 462 to the second stop position 472. Another precisely located jetted hole or set of holes may be created in the well bore as the high pressure fluid is continuously pumped through the tool 400 and out the apertures 426. The tool 400 may again be de-pressurized to allow the lug to move from the locked position 472 to a third relaxed position 475. Re-pressurization of the tool will force the lug to the third stop position 474. From the position 474, the process just described may be repeated through another set of stop positions 470*a*, 472, 474*a* and relaxed positions 477, 473*a*, 475*a*. In other embodiments, the J-slot includes a different number of stop positions and corresponding relaxed positions, such as five or ten. Also, in some embodiments, the slot pattern repeats itself more or less than the two times shown in FIG. 7A. In still further embodiments, the angled slot 462 may instead include curved transitions between the various positions, such that the slot 462 resembles an "S" shape. In other embodiments, the slot 462 includes alternative or additional shapes.

The offset of the positions 470*a*, 472, 474*a* allows corresponding longitudinal and, optionally, rotational offset during movement of components described herein, such as the tube 412 and apertures 426. For example, the offset of the positions 470*a*, 472*a*, 474*a* in the X-direction of FIG. 7A translates to longitudinal or axial offset of the apertures 426, and ultimately to longitudinal offset of the holes jetted into the well bore. The offset of the positions 470*a*, 472, 474*a* in the Y-direction of FIG. 7A translates to rotational offset of the apertures 426, and ultimately to longitudinal offset of the holes jetted into the well bore. The longitudinal offset may be isolated, for example, using the rotatable J-slot embodiments described herein, or, optionally, the rotational offset may be added to the longitudinal offset, for example, using the fixed J-slot embodiments described herein.

Figure 7B:
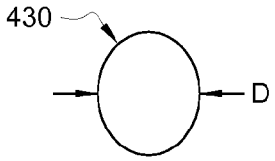
FIGS. 7B-7D are top views of lug shapes.
Figure 7C:
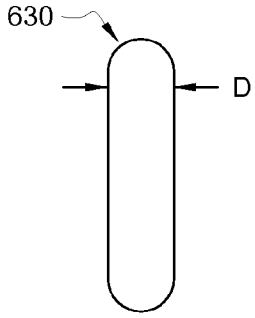
Figure 7D:
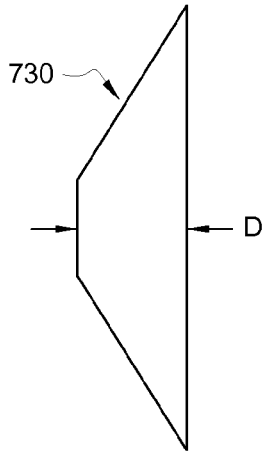
Figure 7E:
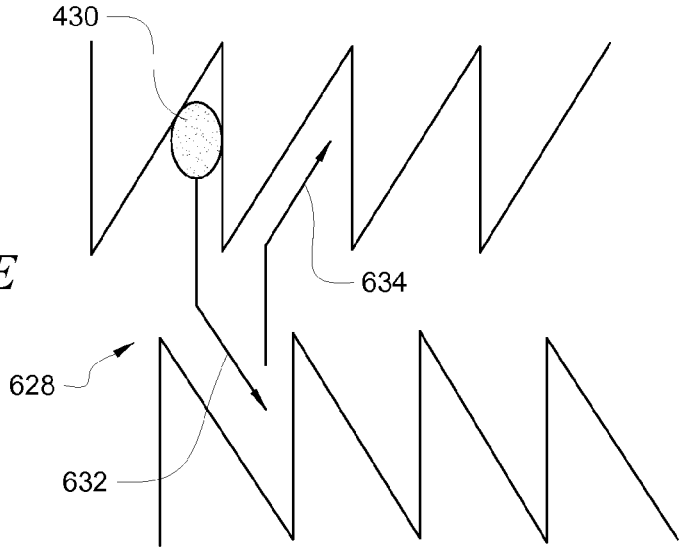
FIG. 7E is a profile view of an indexing slot.

In some embodiments described, the lug 430 includes a circular shape from a top view of the lug, or an oval or elliptical shape shown in FIG. 7B. The minor axis of the lug 430 (or diameter if a circle) includes a distance D. In these embodiments, the lug may be replaced with a set screw with or without a "dog tip." In other embodiments, the lug includes an elongated lug 630 shown in the top view of FIG. 7C. The lug 630 also includes the distance D so that the lug 630 is interchangeable with the lug 430. The elongated lug 630 improves shear strength of the lug. The lugs 430, 630 generally move through the slot 462 of FIG. 7A as intended and previously described. However, it is possible that the lugs 430, 630 may move accidentally in a reverse direction. For example, with reference to FIG. 7A, the lug 430, 630 may move backward through positions 473, 470 instead of forward to positions 475, 474 because of the lugs' accommodating shapes. Thus, in a further embodiment, the lug includes a trapezoidal lug 730 shown in the top view of FIG. 7D. The lug 730 includes the distance D so that the lug 730 is interchangeable with the lugs 430, 630. The lug 730 also includes angled sides that more definitively mate with the angles of the slot 462, thereby ensuring that the lug 730 is more reliably guided through the slot 462. In some embodiments, the J-slot 428, a type of indexing slot, is replaced with an indexing slot 628 shown in the profile view of FIG. 7E. The lug 430, or any other lug described herein, may be urged from one position to the next position along first arrow 632, then on to the next position in the indexing slot 628 along second arrow 634, and so on.

Further operational details of the jetting tool embodiments described herein are discussed with reference to FIG. 8A and a further embodiment represented by a jetting tool 500. The jetting tool 500 is shown including a housing 502 retaining a movable member 512 having a lower end 518 including a jet head 524 and high pressure fluid apertures 526. The housing 502 is shown in cross-section while the remaining inner parts of the tool 500 are shown in full view, for clarity of the following description. A J-slot 528 is disposed adjacent the movable member, or tube, 512 and includes a slot 562. As will be more fully described, the J-slot 528 may or may not be coupled to the tube 512.

Lugs 530 are coupled to the housing 502 and extend inwardly toward the J-slot 528. A slotted member 542 is retained between the housing 502 and the tube 512 and interacts with a lug or lugs 532 extending from the housing 502. Disposed between the J-slot 528 and the slotted member 542 is a locking mechanism 580 having a slip ring 581, a lock ring 582 and a retention member 588. A biasing spring 534 is disposed between a retention member 584 and the lower end 522 of the housing 502. The retention member 584 is coupled to the tube 512 via set screws installed through holes 585. In FIG. 8A, the tool is in a retracted, closed or run-in position wherein the biasing spring 534 is forcing the entire tube assembly upward, limited by the lugs 530 forced into starting positions such as the position 477*a* in FIG. 7A. The locking mechanism 580 assists in defining relative movements of certain parts of the tube assembly.

Figure 8A:
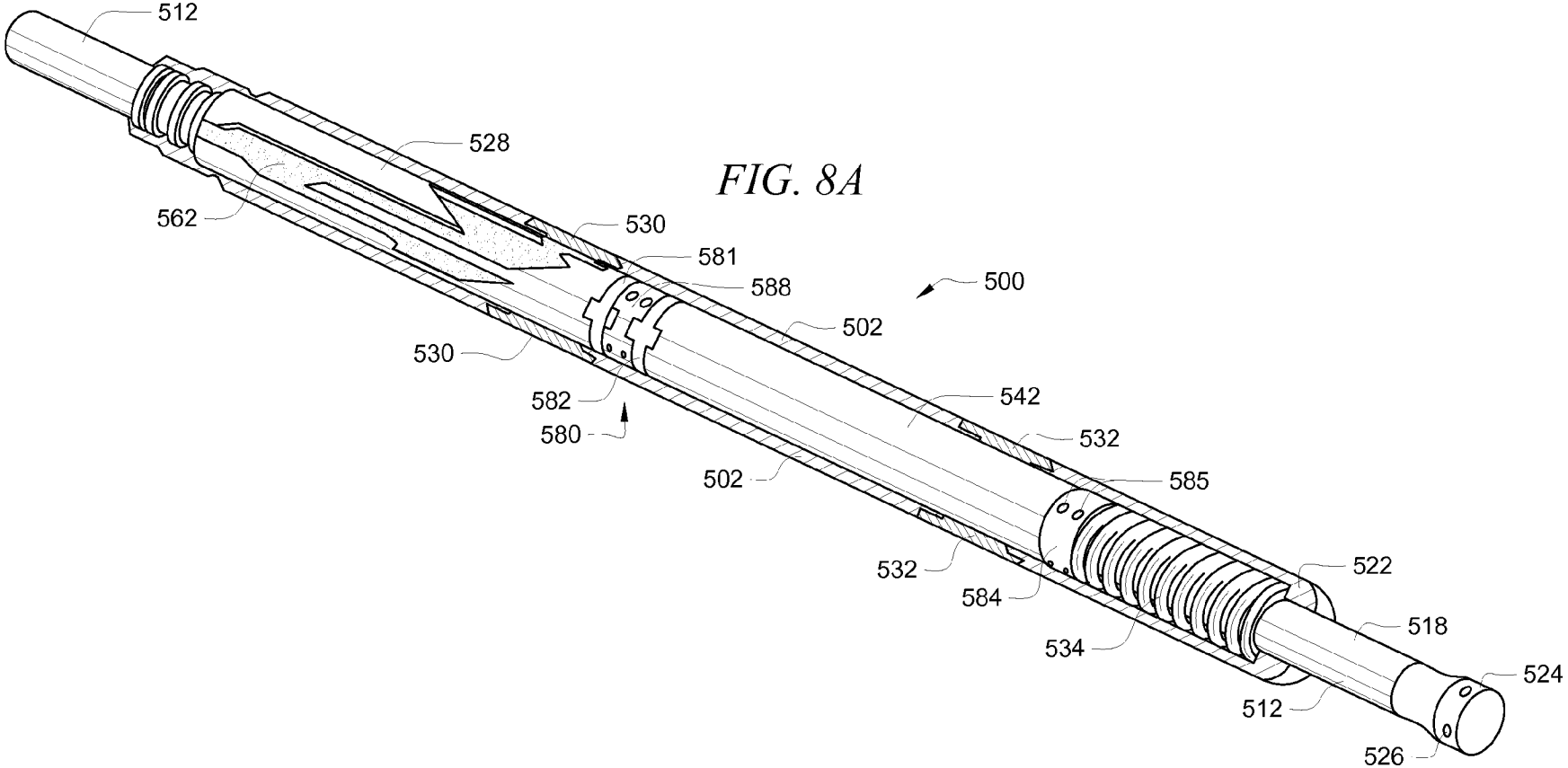
FIG. 8A is a perspective view, in partial cross-section, of an embodiment of a fluid jetting tool with a moveable jet head.
Figure 8B:
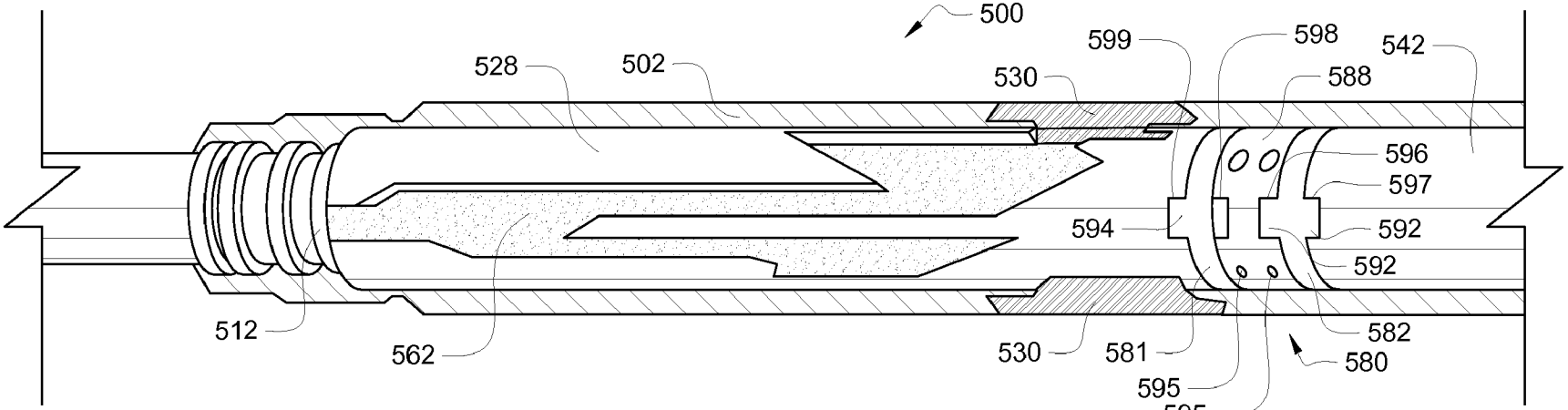
FIG. 8B is an enlarged view of a portion of the fluid jetting tool of FIG. 8A.

In some embodiments of the tool 500, the locking mechanism 580 includes the slip ring 581, the lock ring 582 and the retention member 588 positioned as shown in FIG. 8A. With reference to FIG. 8B, an enlarged view of the locking mechanism 580 is shown. The slip ring 581 includes an extension 594 extending into a receiving slot 599 in the J-slot 528. The retention member 588 includes a set of receiving slots 596, 598. The retention member 588 is affixed or coupled to the tube 512 by set screws installed through holes 595. The lock ring 582 includes a set of extension members 592, one disposed in the receiving slot 596 of the retention member 588, and one disposed in a receiving slot 597 in the slotted member 542. The receiving slot 598 does not contain an extension member because the slip ring 581 does not include a corresponding extension member.

The J-slot 528 is not coupled to the housing 502, nor is it directly coupled to the tube 512, such as by attaching an inner surface of the J-slot 528 to the outer surface of the tube 512, and is allowed to rotate relative to the tube 512 like the J-slot 428 of the embodiment of FIGS. 4A and 4B. Further, the J-slot 528 is not coupled to the tube 512 via the locking mechanism 580 because slip ring 581 allows rotational movement between the J-slot 528 and the retention member 588. The slotted member 542, having an axial slot and lug similar to the slotted member 442 of FIGS. 4A and 4B, is coupled to the tube 512. However, unlike the slotted member 442 of FIG. 4B, the slotted member 542 is not directly coupled to the tube 512 but is connected to the tube 512 via the lock ring 582 and retention member 588. Therefore, as the tool 500 is operated, the interlocked J-slot 528 and slip ring 581 portions of the tube assembly are allowed to rotate relative to the retention member 588 coupled to the tube 512, while the separately interlocked slotted member 542, lock ring 582 and retention member 588 are fixed relative to the tube 512. Consequently, the arrangement of the locking mechanism as shown in FIG. 8B allows axial movement of the tube assembly only, restricting rotational movement of the tube 512 as described herein.

In other embodiments of the tool 500, the positions of the slip ring 581 and the lock ring 582 are switched, thereby allowing rotational movement of the tube 512 in addition to axial movement. In such embodiments, the slip ring 581 is placed in the lock ring 582 position shown in FIG. 8B, with the extension 594 now extending into the receiving slot 596 and the receiving slot 597 being left open. The lock ring 582 is now placed in the aforementioned slip ring 581 position, with the extensions 592 extending into the receiving slots 598, 599. This arrangement interlocks the J-slot 528, the lock ring 582, the retention member 588 and the tube 512, and separately interlocks the slip ring 581 and the slotted member 542, while allowing rotation between the separately interlocked components. While the tool 500 is operated consistent with the teachings herein, the J-slot 528 now coupled to the tube 512 rotates the tube 512 relative to the housing 502. The slip ring 581 now allows rotation between the retention member 588 and the slotted member 542, effectively disengaging the slotted member 542 (which is responsible for preventing rotational motion of the tube 512) from the interlocked J-slot 528 and tube 512. Thus, the tube 512 rotates freely relative to the slotted member 542, and the tool's jet head and jetting apertures include both axial and rotational movement components.

Still referring to FIG. 8B, an enlarged view of the slot and locking mechanism portions of the tool 500 are shown. For convenience of description, the locking mechanism 580 is shown and described in the axial movement only position as previously described. In other embodiments, the locking mechanism is manipulated to allow both rotational and axial movement of the tube 512, such embodiments being consistent with the details described below. The lugs 530 are in starting positions such as positions 477, 477*a* of FIG. 7A. The locking mechanism 580 prevents rotational movement of the tube 512. The tool 500 is biased to this position by the spring 534, when the tool 500 is de-pressurized. This is the typical run-in position of the tool 500.

Figure 8C:
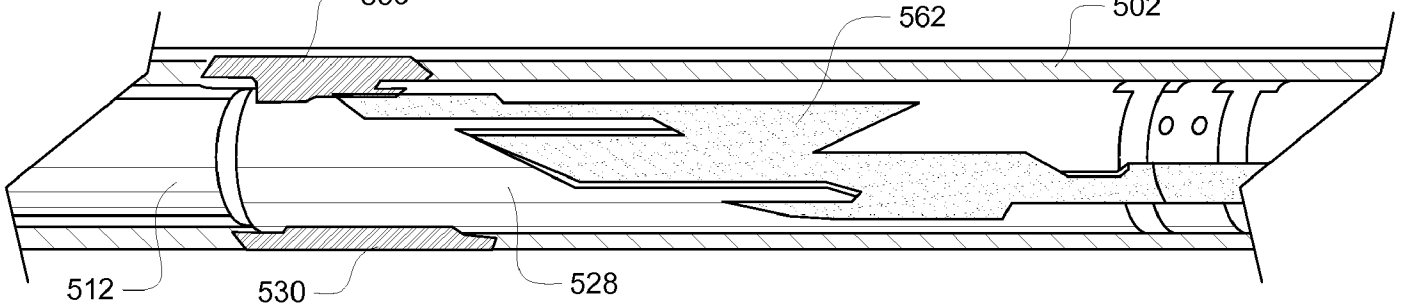
FIG. 8C is the fluid jetting tool of FIG. 8B in another position.

Referring now to FIG. 8C, the tool 500 is pressured up by a high pressure fluid delivered by a work string coupled to the upper end of the tool. The high pressure fluid provides a force to the tube 512 that overcomes the biasing spring 534 of FIG. 8A, and the lugs 530 are guided from the start position to a first stop position as shown in FIG. 8C and represented by the position 470 of FIG. 7A. The high pressure fluid may be continuously pumped in this position to perforate the well bore, as the apertures 526 of FIG. 8A provide a high pressure fluid stream to the well bore.

Figure 8D:
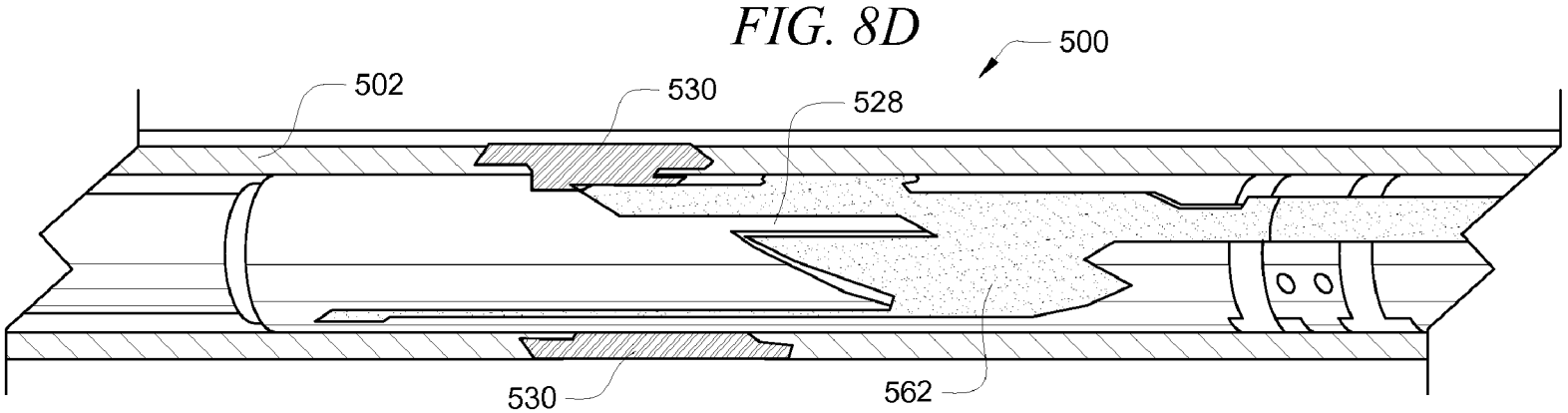
FIG. 8D is the fluid jetting tool of FIG. 8C in another position.

When it is desired to create new jetted holes in the well bore, the apertures 526 may be moved axially (and, in some embodiments, also rotationally). The tool 500 is de-pressurized, the biasing spring 534 acts on the tube 512, and the tool 500 is re-pressurized to finally move the lug 530 into a second stop position, as shown in FIG. 8D and represented by the position 472 of FIG. 7A. The high pressure fluid stream provided by the aperture or apertures 526 creates another jetted hole or set of jetted holes that are axially aligned with the first hole or holes. The tool arrangements described herein that provide axial only movement of the tube or other movable member allow the separately jetted holes in the well bore to be axially or longitudinally aligned. In alternative embodiments, the tool arrangements described herein providing axial and rotational movement of the tube or other movable member allow the separately jetted holes in the well bore to be aligned diagonally relative to the well bore axis. In both cases, the jetted holes are axially spaced.

It is noted that longitudinally or diagonally aligned holes in the well bore are described with reference to the measured depth, length or run of the well bore, which may or may not correspond with the vertical depth of the well bore. For example, in a vertical well, the vertical depth of the tool is the same as the measured depth, and the well bore axis and the tool axis substantially coincide. Aligned jetted holes created by the embodiments of the tool described herein are aligned, either longitudinally or diagonally, along the measured and vertical depths of the well bore and relative to the well bore and tool axes. Alternatively, the tool may be located in a deviated, lateral, horizontal or curved well bore. In such a well, the jetted holes are aligned along the measured length of the well bore, and relative to the well bore axis adjacent the location of the tool in the well bore, rather than the vertical depth of the well bore of the axis of the tool.

Figure 8E:
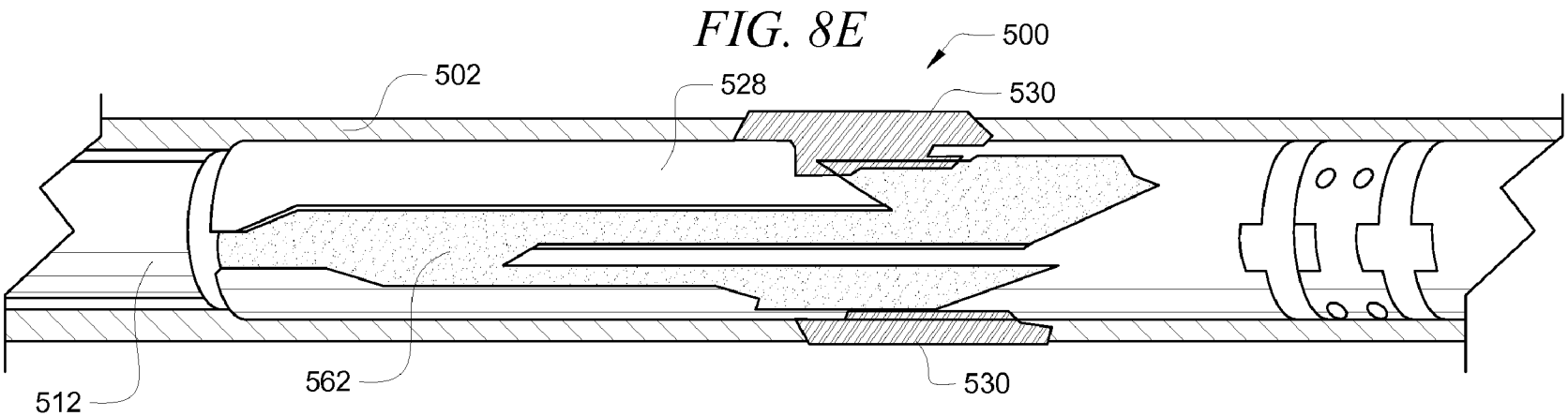
FIG. 8E is the fluid jetting tool of FIG. 8D in another position.

Referring back to the operation of the tool 500, and FIG. 8E, the pressurization process may be repeated again to place the lugs 530 in a third stop position. As shown in FIG. 8E, the lugs 530 stop at the third position represented by the position 474 of FIG. 7A. As previously suggested, the number of stop positions of the tool 500 may be more or less than three to create a plurality of aligned jetted holes in the well bore as described herein.

Various disclosed embodiments include a fluid jetting tool having axially moveable fluid jetting apertures. The embodiments include precise movement of the apertures so that the pattern of holes created in the formation is predictable. The apertures may be moved independently of the work string, in cases where the work string is fixed either purposely or inadvertently. The apertures may be moved independently of the tool housing as well. The movement of the apertures may be adjusted to include a rotational component in addition to the axial component.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A well bore servicing apparatus comprising:

a housing having a longitudinal axis and a through bore; and a movable member disposed in said housing, said movable member having a through bore and a fluid aperture therein;

a J-slot and lug disposed within said J-slot guiding relative movement between said movable member and said housing, wherein said J-slot is rotatably disposed between said housing and said movable member;

an axially slotted member and a second lug disposed in said axially slotted member to prevent rotation of said movable member relative to said axis, wherein said axially slotted member is disposed between said housing and said movable member; and a locking mechanism disposed between said J-slot and said axially slotted member, wherein said locking mechanism is disposed between said housing and said movable member;

wherein said movable member is movable between a first stop position and a second stop position relative to said housing and along said axis;

wherein said fluid aperture is in fluid communication with said housing through bore and said movable member through bore to provide a fluid stream to the well bore in said first and second axially spaced stop positions.

2. The apparatus of claim 1, wherein said lug is coupled to said movable member.

3. The apparatus of claim 1, wherein the locking mechanism further comprises a slip ring, a lock ring and a retention member.

4. The apparatus of claim 3, wherein:

said retention member is coupled to said movable member;

said slip ring is coupled to said J-slot and disposed between said J-slot and said retention member; and said lock ring is coupled between said retention member and said axially slotted member.

5. A method of servicing a well bore comprising:

disposing a tool string comprising the well bore servicing apparatus of claim 1 in the well bore;

positioning the fluid aperture at a first location in the well bore;

fixing the tool string in the well bore;

pumping a well bore servicing fluid through the tool string to the fluid aperture at the first location;

moving the fluid aperture relative to the fixed tool string to an axially spaced second location in the well bore; and pumping the well bore servicing fluid at the axially spaced second location.

6. The method of claim 5, further comprising forming one or more jetted holes in a well bore casing, an adjacent formation, or both at the first and second locations.

7. A method of servicing a well bore comprising:

placing the well bore servicing apparatus of claim 1 in the well bore via a workstring;

actuating the well bore servicing apparatus through one or more longitudinal positions; and forming a corresponding one or more longitudinal jetted holes in the well bore.

8. The method of claim 7, wherein the workstring is held in a substantially fixed longitudinal position during actuation of the well bore servicing apparatus.

9. The method of claim 7, wherein the well bore servicing apparatus is actuated through a plurality of longitudinally spaced slots.

10. The method of claim 7, wherein the well bore servicing apparatus is actuated via one or more pressure differentials.

11. The method of claim 7, wherein the well bore is deviated.

12. A method of servicing a well bore comprising:

disposing the well bore servicing apparatus of claim 1 in the well bore;

providing a fluid to the well bore servicing apparatus and the fluid aperture;

applying a fluid stream from the fluid aperture to the well bore to create a jetted hole in the well bore; and axially aligning a plurality of jetted holes in the well bore.

13. The method of claim 12, further comprising initiating one or more fractures in the formation adjacent the jetted holes.

14. The apparatus of claim 1, wherein said lug is coupled to said housing.

15. The apparatus of claim 4, wherein said lug is coupled to said housing.

16. The apparatus of claim 1, wherein the fluid aperture contains a fluid jet forming nozzle and the well bore servicing tool is a hydrojetting tool.

17. The apparatus of claim 15, wherein the fluid aperture contains a fluid jet forming nozzle and the well bore servicing tool is a hydrojetting tool.

18. The apparatus of claim 1, further comprising a spring disposed within the housing and positioned around the movable member and between the axially slotted member and an end of the housing.

19. The apparatus of claim 17, further comprising a spring disposed within the housing and positioned around the movable member and between the axially slotted member and an end of the housing.

20. The apparatus of claim 3, wherein the position of the slip ring and the lock ring are selectively reversible.

21. The apparatus of claim 19, wherein the position of the slip ring and the lock ring are selectively reversible.

22. The apparatus of claim 4, wherein said lug is coupled to said movable member.

* * * * *